United States Patent [19]

Genakis

[11] 4,235,086

[45] Nov. 25, 1980

[54] PIN TUMBLER LOCK

[76] Inventor: Joseph M. Genakis, 948 W. Boylston St., Worcester, Mass. 01606

[21] Appl. No.: 37,420

[22] Filed: May 9, 1979

[51] Int. Cl.[3] ..... E05B 27/04

[52] U.S. Cl. ..... 70/364 A; 70/378

[58] Field of Search ..... 70/378, 392, 364 A, 70/376, 419, 416

[56] References Cited

U.S. PATENT DOCUMENTS

| | | | |
|---|---|---|---|
| 1,438,336 | 12/1922 | Schroeder | 70/364 A |
| 3,499,302 | 3/1970 | Spain | 70/364 A |
| 4,103,526 | 8/1978 | Surko | 70/364 A |

*Primary Examiner*—Robert L. Wolfe

*Attorney, Agent, or Firm*—John E. Toupal

[57] ABSTRACT

A tumbler lock including a housing that defines a keyway and a plurality of tumblerways communicating therewith. Disposed for both reciprocating and rotational movement in each of the tumblerways is a pin tumbler movable from locked positions into at least one shear position comprising predetermined longitudinal and angular positions. A release mechanism is movable from a closed position into an open position with all the tumblers in their shear positions and is restrained in its closed position with any of the tumblers in one of its locked positions. Cooperating with the lock is a key having a plurality of alignment ridges, each one adapted to enter an alignment groove on one of the pins and to move the pin into its shear position.

15 Claims, 25 Drawing Figures

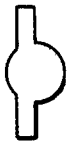
FIG 17
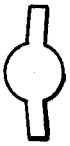
FIG 18
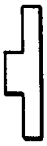
FIG 19
FIG 15
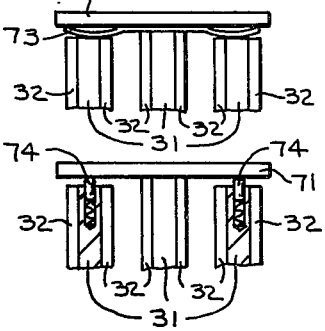
FIG 16
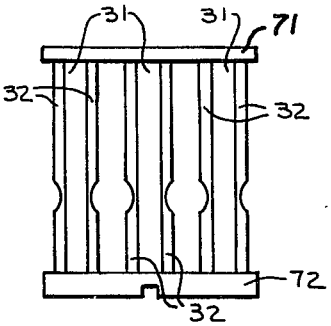
FIG 14
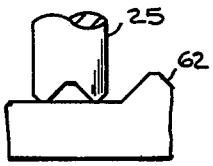
FIG 20
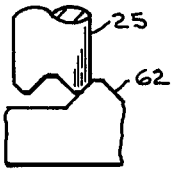
FIG 21
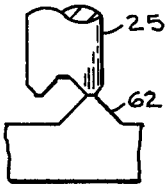
FIG 22
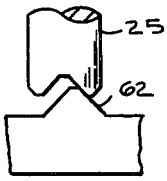
FIG 23
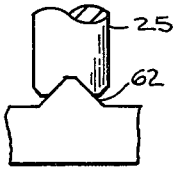
FIG 24
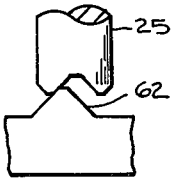
FIG 25

PIN TUMBLER LOCK

BACKGROUND OF THE INVENTION

This invention relates generally to a key operated tumbler lock and, more particularly, to a high security lock highly resistant to the picking techniques normally employed to violate tumbler locks.

As is well known in the lock industry, most tumbler locks are quite susceptible to violation by persons skilled in picking techniques. In most instances, a picker employs the sense of feel to sequentially move individual tumblers to their shear positions while maintaining tension on a movable portion on a lock. Because of efforts to complicate the steps required to breach security, locks of varying configuration and with diverse operational characteristics have been developed. One of the best known and most inviolate commercially available lock is the so-called Medeco cylinder lock disclosed in U.S. Pat. No. 3,499,302. That lock employs a key specially bitted with V-shaped cuts that both elevate and rotate pin tumblers into shear positions that entail a predetermined positioning of pin tumblers both longitudinally and angularly within their pinways. Although providing a high degree of security, the Medeco lock does suffer from one disadvantage. Because the individual pins possess ridges that mate with the V-shaped notches in the key and establish pin elevation, they are far more susceptible to wear than are the relatively smooth surfaced pins employed in conventional cylinder locks. Such wear can ultimately degrade or even prevent normal use of a lock with a properly bitted key.

The object of this invention, therefore, is to provide an improved key operated tumbler lock that is highly resistant to picking and is less susceptible to wear than prior high security locks.

SUMMARY OF THE INVENTION

The invention comprises a tumbler lock including a housing that defines a keyway and a plurality of tumblerways communicating therewith. Disposed for both reciprocating and rotational movement in each of the tumblerways is a pin tumbler movable from locked positions into at least one shear position comprising predetermined longitudinal and angular positions. A release mechanism is movable from a closed position into an open position with all the tumblers in their shear positions and is restrained in its closed position with any of the tumblers in one of its locked positions. Cooperating with the lock is a key having a plurality of alignment ridges, each one adapted to enter an alignment groove on one of the pins and to move the pin into its shear position. The depth of the valleys in the pin tumbler grooves rather than the ridges that define the valleys are used to establish proper shear elevation for the pins. These valleys are far less susceptible to wear than the ridges themselves which as described above are the critical portions of the Medeco lock.

In a preferred embodiment of the invention, the valleys defined by the pin grooves, the apices of the ridges establishing those grooves and the apices of the mating ridges on the key are all flattened. The use of flat portions on these critical contact areas also serves to reduce wear that would ultimately degrade lock performance.

One feature of the invention is the provision of individual stops that limit rotational movement of each pin tumbler to substantially less than 180 degrees. The stops prevent alignment of the pin tumbler grooves with the keyway. Such an orientation could prevent proper aligning engagement between the pin grooves and the transverse key ridges.

Another feature of the invention is the provision of a release mechanism composed of a plurality of selectors that are rectilinearly movable in the housing between open and closed positions in directions transverse to the pinways. The selectors are provided with fin portions that are accommodated by slots in the surfaces of the pins during movement of the selectors to their open positions. The pins are provided also with spiral grooves of lesser depth that do not accommodate movement of the selectors to their open positions but tend to engage the selector fins during picking attempts and thereby complicate such activities.

Still another feature of the invention is the provision of a coupling mechanism that establishes sympathetic movement of the selectors but allows a limited relative movement therebetween. This feature also encourages engagement between the selector fins and the false spiral grooves during picking attempts.

DESCRIPTION OF THE DRAWINGS

These and other objects and features of the present invention will become more apparent upon a perusal of the accompanying drawings wherein:

FIG. 14 is a schematic view of a selector release mechanism shown in FIG. 1;

FIG. 15 is a schematic view of a modified selector release mechanism;

FIG. 16 is a schematic view of another selector release mechanism embodiment;

FIGS. 17–19 are schematic views of keyway openings suitable for use in the lock of FIG. 1; and FIGS. 20–25 are schematic partial views of sequential engagement positions between a portion of a key and a pin tumbler.

DESCRIPTION OF THE PREFERRED EMBODIMENTS

Figure 1:
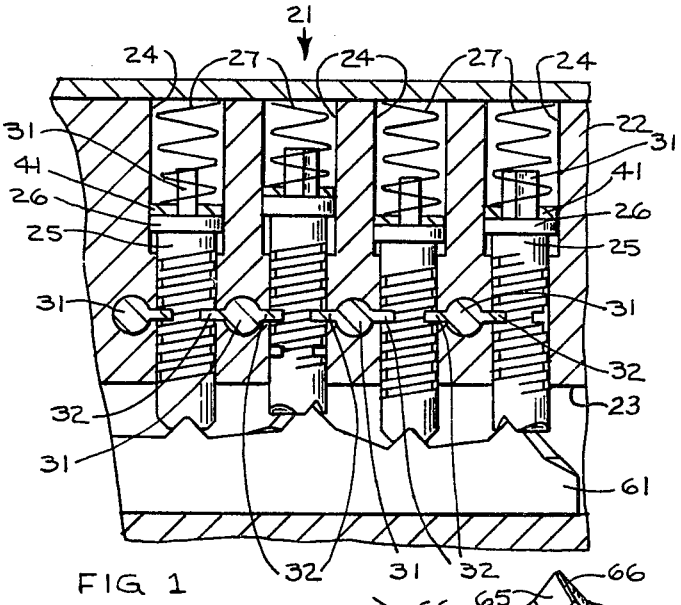
FIG. 1 is a schematic partial cross-sectional view of a tumbler lock according to the present invention.

Referring now to FIG. 1, there is shown a lock 21 constructed in accordance with the present invention. The lock 21 includes a housing 22 that defines a keyway 23 and a plurality of tumblerways or pinways 24 communicating therewith. Mounted for both reciprocating and rotational movement in each of the pinways 24 is a pin tumbler 25. Each of the pins 25 includes a flange portion 26 that is accommodated by an internal shoulder in its pinway 24 so as to limit its downward movement. Biasing each pin in a downward direction is a spring member 27.

Also accommodated by the housing 22 is a release assembly composed of a plurality of cylindrical selector rod members 31 each having fin portions 32 extending therefrom. With the pins 25 in shear positions, the selector rods 31 are rectilinearly movable within the housing 22 between closed and open positions in a direction transverse to the pinways 24. Associated with the selector rods 31 and operationally dependent thereon is a latch mechanism (not shown) for controlling access to an enclosure. A more detailed description of certain structural features of the lock 21 appears in U.S. Patent application No. 785,655.

Figure 7:
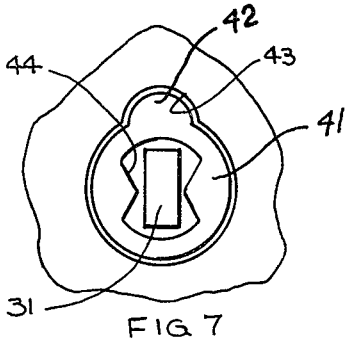
FIG. 7 is a schematic top view illustrating the operational relationship between the pin of FIG. 2 and the stop of FIG. 5.
Figure 5:
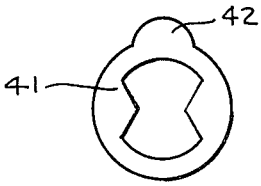
FIG. 5 is a schematic plan view of an annular stop utilized in the lock of FIG. 1.
Figure 6:
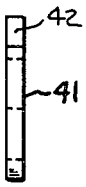
FIG. 6 is a schematic side view of the annular stop shown in FIG. 5.
Figure 3:
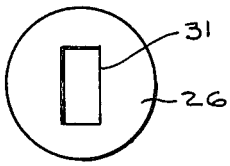
FIG. 3 is a schematic top view of the pin tumbler shown in FIG. 2.
Figure 2:
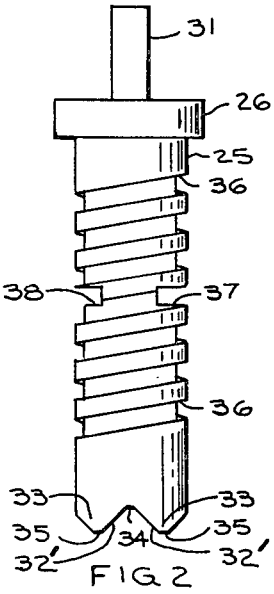
FIG. 2 is a schematic elevational view of a pin tumbler utilized in the lock of FIG. 1.
Figure 4:
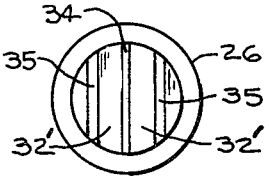
FIG. 4 is a schematic bottom view of the pin tumbler shown in FIG. 2.

Referring now to FIGS. 2–4, there is shown in greater detail a pin tumbler 25. An upper end of the pin 25 is terminated with a rectangularly shaped stem portion 31 and a lower end thereof defines a groove 32' defined by a pair of parallel ridges 33. A valley portion 34 of the groove 32' is flattened as are the apices 35 of the ridges 33. Defined along substantially the entire length of the cylindrical pin tumbler 25 is a spiral groove 36. Also formed in the surface of the pin 25 on opposite sides thereof are a pair of horizontal slots 37 and 38 of greater depth than the spiral groove 36 oriented substantially parallel to the groove 32'. As shown more clearly in FIGS. 5–7, an annular stop washer 41 is fitted over the rectangularly shaped stem 31 of each pin tumbler 25. Each of the stop members 41 includes an ear portion 42 that is retained by a recess 43 in the housing 22 so as to prevent rotational movement thereof. As illustrted in FIG. 7, an aperture 44 in the stop member 45 is shaped so as to limit rotational movement of the stem 31 to substantially less than 180 degrees.

Figure 8:
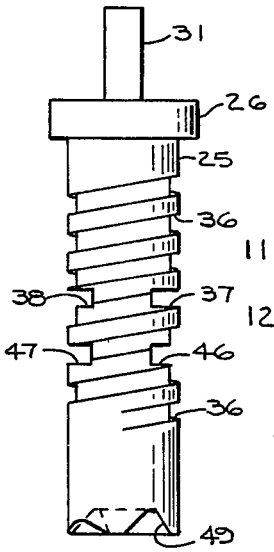
FIG. 8 is a schematic elevational view of a modified pin tumbler.
Figure 9:
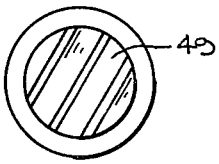
FIG. 9 is a schematic bottom view of a pin tumbler shown in FIG. 8.

Referring now to FIGS. 8 and 9, there is shown a modified pin tumbler for which portions identical to those illustrated in FIG. 2 have been given the same reference numerals. Again the surface of the pin 25 is interrupted by a spiral groove 36 of one depth and a pair of deeper horizontal slots 37 and 38. This pin is provided additionally however with a second pair of horizontal slots 46 and 47 longitudinally spaced from the grooves 37 and 38. Also, a lower end of the pin 25 defines a groove 49 identical to the groove 32' shown in FIGS. 2 and 4. However, the groove 49 is not parallel to the slots 37, 38, 46 and 47 but rather is oriented at an angle thereto.

Figure 10:
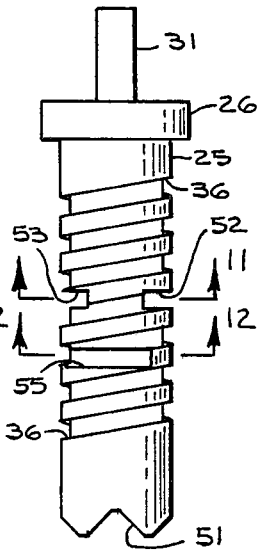
FIG. 10 is a schematic plan view of another pin tumbler embodiment.
Figure 11:
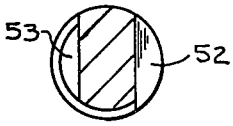
FIG. 11 is a schematic cross-sectional view taken along lines II—II of FIG. 10.
Figure 12:
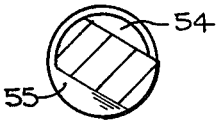
FIG. 12 is a schematic cross-sectional view taken along lines 12—12 of FIG. 10.

Referring now to FIGS. 10–12, there is shown another type of tumbler 25 for which portions identical to those shown in FIG. 2 have been given for the same reference numerals. The surface of the pin tumbler 25 is again interrupted by a spiral groove 36 of shallow depth and has a lower end that defines a groove 51. Also defined by the surface of the pin tumbler 25 is a first pair of deeper, horizontally oriented slots 52 and 53 that are parallel to the groove 51 and a second pair of deeper, horizontally oriented slots 54 and 55 that are oriented at an angle to the groove 51.

Figure 13:
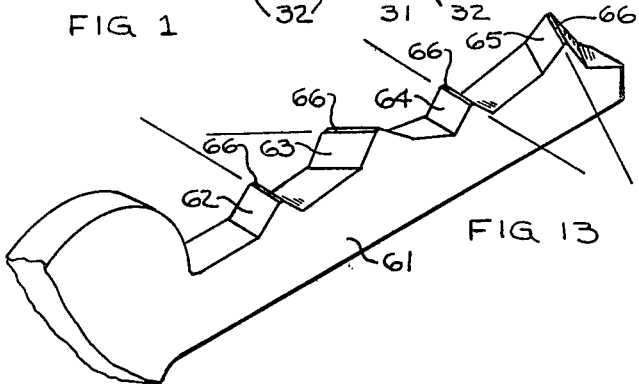
FIG. 13 is a perspective view of a key shown in FIG. 1.

During use of the lock 21, a specially bitted key 61 is inserted into the keyway 23 and engages the pin tumblers 25 as shown in FIG. 1. As shown in FIG. 13, the key 61 is cut so as to possess a plurality of V-shaped ridges 62–65 each of which has a flattened apex 66. The ridges 62–65 are longitudinally spaced so as to engage each of the grooves formed at the lower ends of the pin tumblers 25. Engagement between the pin grooves and the key ridges produces a predetermined angular orientation of the pins 25 while engagement between the valley portions 34 and the apices 66 establishes a predetermined elevation for each of the pins. In order to move the pins 25 from locked positions into shear positions, the deeper slots therein must be positioned at the elevation of the selector fins 32 and oriented parallel to the direction of movement thereof. It will be obvious that this function is accomplished by establishing suitable heights for the apices 66 on the key 61 and by predetermined orientations of the key ridges 62–65. For example, the ridge 62 which is oriented transversely to the longitudinal axis of the key 61 would interact with the groove 32' to produce proper alignment of the slots 37 and 38 while the ridge 63 which is oriented at an angle to the longitudinal axis of the key 61 would engage the pin groove 49 to produce proper alignment of the deep pin slots 37 and 38. It will be obvious that the additional slots 46 and 47 shown in FIG. 8 can be used for master keying. An operator's key would possess a ridge 63 with an elevation suitable to bring the pin slots 37 and 38 into alignment with the selector fins 32 while a master key would possess a ridge of greater elevation so as to bring the pin slots 46 and 47 into alignment therewith. Similarly, the multiple pairs of deep slots 52, 53, 54 and 55 of the pin 25 in FIG. 10 could be used for master keying. In this case, however, the ridges on an operator and master key associated with the groove 51 would differ both in elevation and in orientation with respect to the longitudinal axis of the key 61.

The stop washers 41 limit maximum rotational movement of the pins so as to prevent alignment of the alignment grooves with the longitudinal axis of the keyway 23. This is an important feature in that such alignment could prevent engagement between the pin grooves 32' and the key ridges 62 on a properly bitted key thereby preventing desired operation of the lock. In addition, by providing bearing surfaces for the spring members 27 and washers 41 insure the desired rotatability of the pins 25. Direct contact between the spring members 27 and the pins 25 could create a frictional bonding that would obstruct desired rotation thereof.

FIG. 14 is a plan view of the release assembly illustrated in FIG. 1. As shown, the ends of the selector rods 31 are secured between a pair of end plates 71 and 72 so as to be movable as a single unit in a direction transverse the axes of the pins 25. As noted above, such movement is required to operate a suitable latch mechanism (not shown) and is possible only after the pins 25 are in shear positions with their deep slots aligned with the fins 32. During attempts to pick the lock 21, the fins 32 tend to engage the spiral grooves 36 which are not deep enough to permit release movement of the rods 31. However, engagement between the fins 32 and the grooves 36 prevents further movement of the pins 25 into shear positions and subverts a picking attempt. A further description of this operation is presented in the above-identified U.S. Patent application No. 785,655.

FIGS. 15 and 16 partially illustrate other embodiments of a release assembly for use in the lock 21. As shown in FIG. 15, the selector rods 31 are coupled to the end piece 71 by a leaf spring 73 that allows a limited degree of relative movement between the individual rods 31. The limited ability of the outer rods 31 to move independently enhances the possibility that one of the fins 32 will move into engagement with one of the shallow pin grooves 36 during a picking attempt. Such engagement will prevent further movement of the engaged fin into a shear position. FIG. 16 shows another embodiment of this type in which relative movement between the rods 31 is accommodated by spring loaded pins 74 that couple the rods 31 to the end piece 71.

FIGS. 17–19 illustrate keyway geometries that could be used when the lock 21 is provided with a double bitted key adapted for insertion from opposite sides of the lock. The asymmetrical configuration of the keyways would be accommodated by mated structure on a key and insure insertion thereof with the proper orientation.

FIGS. 20–25 partially illustrate sequential relative positions between an alignment ridge 62 and a pin 25 during insertion of a key 61. As shown, the critical valley portion of the pin groove engages the ridge 62, only during a very limited period of the indicated key travel. For this reason the valley portion is subjected to a minimum of wear that would influence lock operation. Furthermore, a valley is less subject to wear than a ridge and the elevations of the ridges on the pins 25 are not critical to lock operation. Wear is further reduced by the provision of flat surfaces for the pin groove valleys 34, the apices 35 of the ridges defining those valleys and the apices 66 of the key ridges. Although the elevation of the key ridges 62 are critical to lock operation, it will be noted that these ridges are subjected to wear only during contact with a pin 25 and thus occurs only intermittently during key travel. Furthermore, wear of a key is less serious than wear of pins since replacement can be more readily accomplished.

Obviously, many modifications and variations of the present invention are possible in light of the above teachings. It is to be understood, therefore, that the invention can be practiced otherwise than as specifically described.

What is claimed is:

1. A lock comprising:

housing means defining a keyway and a plurality of tumblerways communicating therewith;

a tumbler disposed in each of said tumblerways and adapted for both reciprocating and rotational movement therein, each of said tumblers movable between locked positions into at least one shear position comprising both a predetermined longitudinal position and a predetermined angular position within its said tumblerway, each of said tumblers comprising one end surface defining an alignment groove extending into said keyway;

release means movable between open and closed positions and adapted for operative coupling with a latch mechanism, said release means being movable from said closed position to said open position with all of said tumblers in said shear positions and being restrained in said closed position with any of said tumblers in one of said locked positions; and a key insertable into said keyway and having a plurality of alignment ridges that are adapted to enter each of said alignment grooves, the elevation and orientation of said alignment ridges being such as to move said tumblers into their shear positions.

2. A lock according to claim 1 wherein said alignment ridges are nonparallel.

3. A lock according to claim 1 wherein said ridges are substantially V-shaped with substantially flat apices.

4. A lock according to claim 2 wherein said alignment grooves are formed between substantially parallel ridges having substantially flat apices.

5. A lock according to claim 1 wherein said alignment grooves comprise substantially flat valley portions.

6. A lock according to claim 1 including stop means for limiting rotational movement of said tumblers to substantially less than 180 degrees.

7. A lock according to claim 6 wherein said stop means maintains said tumblers in positions wherein said grooves are transverse to said keyway.

8. A lock according to claim 7 wherein said tumblers comprise eccentric stem portions extending from ends opposite to said one ends, and said stop means comprise an annular member receiving each of said stems and fixed to said housing, said annular members having openings shaped and arranged to limit said rotational movement of said tumblers.

9. A lock according to claim 8 including a spring member for biasing each of said tumblers into a lock position, each of said spring members extending between said housing and the surface of one of said annular members.

10. A lock according to claim 1 wherein said tumblers comprise pins and said tumblerways comprise parallel pinways, said release means comprises a plurality of locking selectors rectilinearly movable in said housing between open and closed positions in a direction transverse to said pinways, said housing means prevents movement of said pins in the direction of movement of said selectors, and said pins and said selectors are shaped and arranged to engage and prevent said movement of said selectors with said pins in said locking positions and to disengage so as to permit said movement of said selectors with said pins in said shear positions, said pins and said selectors being further shaped and arranged to engage in response to movement of said selectors out of said closed positions and thereby prevent said movement of said pins.

11. A lock according to claim 10 wherein each of said selectors comprises an elongated body portion and fin portions extending therefrom, each of said pins comprise cylindrical surfaces interrupted by spaced apart slots at least some of which are substantially parallel to said fins, and said engagements occur between said fin portions and said slots.

12. A lock according to claim 11 wherein said some slots extend around only a portion of the entire periphery of said pins.

13. A lock according to claim 12 wherein said substantially parallel slots in each of said pins are of a depth that accommodates movement therethrough of said fin portions and including other slots of a lesser depth that prevents movement therethrough of said fin portions.

14. A lock according to claim 13 wherein said other slots are in the form of a spiral on said pin surface.

15. A lock according to claim 14 wherein said selectors are coupled for movement together, and including lost motion means for permitting limited relative movement between said selectors.

* * * * *